US009063455B2

(12) United States Patent
Maeda et al.

(10) Patent No.: US 9,063,455 B2
(45) Date of Patent: Jun. 23, 2015

(54) LIGHT-EMITTING SUBSTRATE, METHOD FOR MANUFACTURING THE SAME, OPTICAL WRITING DEVICE, AND IMAGE FORMING APPARATUS

(71) Applicants: Katsuhiko Maeda, Kanagawa (JP); Hiroyuki Basho, Kanagawa (JP); Masashi Suzuki, Saitama (JP); Yuugo Matsuura, Kanagawa (JP)

(72) Inventors: Katsuhiko Maeda, Kanagawa (JP); Hiroyuki Basho, Kanagawa (JP); Masashi Suzuki, Saitama (JP); Yuugo Matsuura, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 13/964,304

(22) Filed: Aug. 12, 2013

(65) Prior Publication Data

US 2014/0063168 A1 Mar. 6, 2014

(30) Foreign Application Priority Data

Aug. 28, 2012 (JP) ..... 2012-187949

(51) Int. Cl.

| | |
|---|---|
| ***B41J 2/45*** | (2006.01) |
| ***G03G 15/04*** | (2006.01) |
| ***F21K 99/00*** | (2010.01) |
| ***G03G 15/01*** | (2006.01) |

(52) U.S. Cl.

CPC ..... *G03G 15/04036* (2013.01); *F21K 9/50* (2013.01); *G03G 15/011* (2013.01); *G03G 15/04054* (2013.01)

(58) Field of Classification Search

CPC ..... B41J 2/44; B41J 2/442; H01L 24/01; H01L 24/03; H01S 3/025; H01S 3/04; H01S 5/022; H01S 5/02268; H01S 5/02272

USPC ..... 347/224, 225, 238; 206/718, 719, 722, 206/728

See application file for complete search history.

(56) References Cited

U.S. PATENT DOCUMENTS

| | | | |
|---|---|---|---|
| 2001/0028387 | A1 | 10/2001 | Maeda |
| 2003/0001945 | A1 | 1/2003 | Maeda |
| 2003/0030718 | A1 | 2/2003 | Maeda |
| 2004/0070661 | A1 | 4/2004 | Maeda |
| 2004/0095454 | A1 | 5/2004 | Maeda |
| 2004/0160506 | A1 | 8/2004 | Maeda |
| 2004/0239747 | A1 | 12/2004 | Maeda |
| 2005/0184229 | A1 | 8/2005 | Maeda |

(Continued)

FOREIGN PATENT DOCUMENTS

| | | | | |
|---|---|---|---|---|
| JP | 02023540 A * | 1/1990 | ..... | G11B 7/12 |
| JP | 2638953 | 4/1997 | | |

(Continued)

*Primary Examiner* — Hai C Pham

(74) *Attorney, Agent, or Firm* — Oblon, McClelland, Maier & Neusadt, L.L.P.

(57) ABSTRACT

A light-emitting substrate including: a first and second light-emitting devices each including terminals; and a substrate including a first hole and a second hole, the first hole and the second hole respectively having at least one receiving portion, wherein the receiving portion of the first hole receives the terminal of the first light-emitting device, and the receiving portion of the second hole receives the terminal of the second light-emitting device, a first line drawn through a center of the receiving portion of the first hole and a center of the first hole, and a second line drawn through a center of the receiving portion of the second hole and a center of the second hole are not aligned in line.

8 Claims, 5 Drawing Sheets

(56) References Cited

U.S. PATENT DOCUMENTS

| | | | |
|---|---|---|---|
| 2005/0200689 | A1 | 9/2005 | Shinohara et al. |
| 2006/0045577 | A1 | 3/2006 | Maeda |
| 2006/0164505 | A1 | 7/2006 | Maeda |
| 2006/0187473 | A1 | 8/2006 | Maeda |
| 2007/0210245 | A1 | 9/2007 | Maeda |
| 2007/0263270 | A1 | 11/2007 | Komai et al. |
| 2008/0174799 | A1 | 7/2008 | Higashiyama et al. |
| 2009/0231606 | A1 | 9/2009 | Kawai et al. |
| 2010/0238261 | A1 | 9/2010 | Maeda |
| 2011/0228030 | A1 | 9/2011 | Maeda |

FOREIGN PATENT DOCUMENTS

| | | | | | |
|---|---|---|---|---|---|
| JP | 2004-079814 | | | 3/2004 | |
| JP | 2004325929 | A | * | 11/2004 | ..... G02B 26/10 |
| JP | 2005070495 | A | * | 3/2005 | ..... G02B 26/10 |
| JP | 2005217206 | A | * | 8/2005 | ..... H05K 3/34 |
| JP | 2010016323 | A | * | 1/2010 | ..... H01S 5/022 |
| JP | 2013062390 | A | * | 4/2013 | ..... H05K 13/14 |

* cited by examiner

LIGHT-EMITTING SUBSTRATE, METHOD FOR MANUFACTURING THE SAME, OPTICAL WRITING DEVICE, AND IMAGE FORMING APPARATUS

CROSS REFERENCE TO RELATED APPLICATION

The present application claims a benefit of priority to and incorporates by reference the entire contents of Japanese Patent Application No. 2012-187949 filed in Japan on Aug. 28, 2012.

BACKGROUND OF THE INVENTION

1. Field of the Invention

The present invention relates to a substrate, an optical writing device, and an image forming apparatus.

2. Description of the Related Art

Conventionally, a light-emitting element, such a laser diode, having a plurality of pin-like terminals is mounted on a substrate by inserting the pin-like terminals into holes provided in the substrate and soldering the terminals to the substrate. In this case, a large number of the terminals of the laser diode make it difficult to insert the terminals into the holes of the substrate, and whereby only slight bending of the terminals may make it impossible to insert the terminals.

Japanese Patent No. 2638953 discloses a technique in which a printed substrate is constituted by a flexible printed substrate backed with a reinforcing plate, and either a hole portion of the flexible substrate is made smaller than a hole portion of the reinforcing plate, or holes of the flexible substrate are connected by slits, thus making it possible to automatically insert terminals of a semiconductor laser into the printed substrate.

However, Japanese Patent No. 2638953 does not disclose mounting of a plurality of light-emitting elements closely. In case of mounting a plurality of light-emitting elements on the substrate closely, the terminals of each light-emitting elements are disposed densely. It leads degradation and difficulty of soldering of the terminals. Therefore, there is a need for providing a substrate, an optical writing device, and an image forming apparatus that can make it easy to solder the terminals of a plurality of light-emitting elements when the light-emitting elements are closely mounted.

SUMMARY OF THE INVENTION

According to an aspect of the invention, a light-emitting substrate is provided. A light-emitting substrate includes: a first light-emitting device including at least one terminal; a second light-emitting device including at least one terminal; and a substrate for mounting the first light-emitting device and the second light-emitting device thereon, the substrate including a first hole having a size capable of passing through the at least one terminal of the first light-emitting device at once and a second hole having a size capable of passing through the at least one terminal of the second light-emitting device at once, the first hole and the second hole respectively having at least one receiving portion concaved in a direction from center of the hole to circumference of the hole, wherein the at least one receiving portion of the first hole receives the terminal of the first light-emitting device, and the at least one receiving portion of the second hole receives the terminal of the second light-emitting device, a first line drawn through a center of the receiving portion of the first hole and a center of the first hole, and a second line drawn through a center of the receiving portion of the second hole and a center of the second hole are not aligned in line.

According to another aspect of the invention, an optical writing device is provided. The optical writing device includes the light-emitting substrate above described; and a photosensitive unit configured to receive a light from the first light-emitting device and the second light-emitting device, thereby electrostatic latent images being written.

According to another aspect of the invention, an image forming apparatus is provided. The image forming apparatus includes the optical writing device above described.

According to another aspect of the invention, a method for manufacturing a light-emitting substrate is provided. The method comprises: preparing a first light-emitting device including at least one first terminal; preparing a second light-emitting device including at least one second terminal; preparing a substrate for mounting the first light-emitting device and the second light-emitting device thereon, the substrate including a first hole having a size capable of passing through the at least one first terminal of the first light-emitting device at once and a second hole having a size capable of passing through the at least one second terminal of the second light-emitting device at once, the first hole and the second hole respectively having at least one receiving portion concaved in a direction from center of the hole to circumference of the hole, and a first line drawn through a center of the receiving portion of the first hole and a center of the first hole, and a second line drawn through a center of the receiving portion of the second hole and a center of the second hole being not aligned in line; passing the at least one first and second terminals through the first and the second holes respectively; spreading the at least one first and second terminals outwardly so that the at least one receiving portion of the first hole receives the at least one first terminal of the first light-emitting device, and the at least one receiving portion of the second hole receives the at least one second terminal of the second light-emitting device; and soldering portions of the at least one first and second terminals that are received by the at least one receiving portion of the first and second holes respectively.

BRIEF DESCRIPTION OF THE DRAWINGS

The above and other objects, features advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Referring to the accompanying drawings, various embodiments of a substrate, an optical writing device, and an image forming apparatus are described below. However, it should be noted that the invention is not limited to such embodiments.

Figure 1:
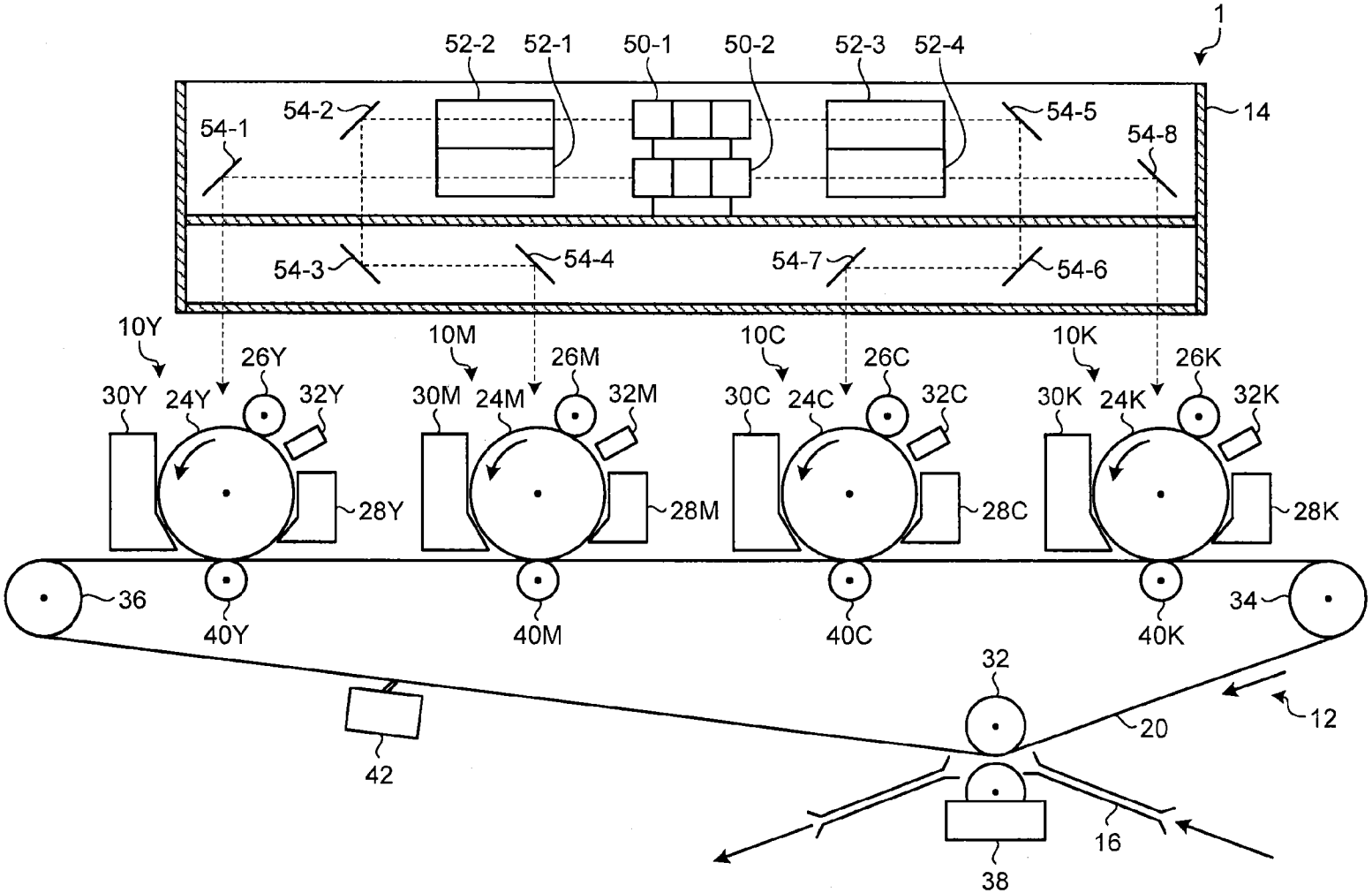
FIG. 1 is a schematic diagram illustrating an image forming apparatus according to an embodiment of the present invention.

FIG. 1 shows an image forming apparatus 1 according to an embodiment. As illustrated in FIG. 1, the image forming apparatus 1 includes for example four (4) image forming units 10, an intermediate transfer unit 12, an optical writing device 14, and a conveying path 16. The image forming apparatus 1 may be an MFP that can run as a combination of a printer function to print image data received from a personal computer (PC), a server via a network, or the like (not illustrated), a function as a full-color copier, a scanner function, and a function as a facsimile apparatus.

In the embodiment, the image forming units 10, which can form a color image, may include a first image forming unit 10Y, a second image forming unit 10M, a third image forming unit 10C, and a fourth image forming unit 10K. The a first image forming unit 10Y, the second image forming unit 10M, the third image forming unit 10C, and the fourth image forming unit 10K corresponds to colors of yellow (Y), magenta (M), cyan (C), and black (K), respectively, and are substantially horizontally arranged in line along the intermediate transfer unit 12 with a predetermined spaced apart.

The four image forming units 10Y, 10M, 10C, and 10K are configured substantially in the same fashion except that developers contained therein have different colors from each other. Hereinafter, when any of the image forming units 10 is referred, the unit is specified with Y, M, C, or K subsequent to the numeral 10.

The intermediate transfer unit 12 rotates an intermediate transfer belt 20 serving as an intermediate transfer subject in the direction of the arrow illustrated in FIG. 1. The four image forming units 10Y, 10M, 10C, and 10K sequentially form developer images of the respective colors based on image data received from an image processing unit (not illustrated). The intermediate transfer unit 12 transfers the developer images formed by the four image forming units 10Y, 10M, 100, and 10K onto the intermediate transfer belt 20 at a timing when the developer images are superimposed.

The conveying path 16 is disposed below the intermediate transfer unit 12. A recording medium such as a sheet fed from a paper feeding unit (not illustrated) is conveyed in the direction of the arrows (i.e., in the same direction as that of the intermediate transfer belt 20) in FIG. 1 in the conveying path 16. The developer images of the respective colors sequentially transferred onto the intermediate transfer belt 20 are transferred onto the recording medium at once. Then, the transferred developer images are fixed by a fixing unit (not illustrated). Finally, the recording medium is discharged to the outside.

Next, various configurations of the image forming apparatus 1 are described below. As described above, the four image forming units 10Y, 10M, 10C, and 10K are configured substantially in the same manner as described above. As an example, the first image forming unit 10Y is described below. The first image forming unit 10Y includes an image carrier 24Y, a charging unit 26Y, a developing unit 30Y, a cleaning unit 28Y, and a neutralization unit 32Y.

The image carrier 24Y is, for example, a cylindrical photosensitive drum, which has a photoconductive layer including at least a charge generation layer and a charge transport layer on a conductive drum made of aluminum or the like, and rotates about the axis in the longitudinal direction thereof (i.e., rotates counterclockwise as illustrated in FIG. 1).

The charging unit 26Y is, for example, a corotron, a scorotron, or a roller charging device, and charges the image carrier 24Y by applying a surface charge thereto.

Here, an electrostatic latent image is formed on the image carrier 24Y by irradiating or exposing the image carrier 24Y charged by the charging unit 26Y with light from the optical writing device 14.

The developing unit 30Y includes a developing roller, a developer supplying roller, a regulating blade, etc., and uses a developer for yellow (Y) contained therein to develop the electrostatic latent image formed on the image carrier 24Y. The developer image developed by the developing unit 30Y is transferred onto the intermediate transfer belt 20.

The other image forming units 10M, 10C, and 10K also form developer images having the colors of magenta (M), cyan (C), and black (K), respectively, in the same manner as the first image forming unit 10Y.

The intermediate transfer unit 12 includes a first primary transfer roller 40Y, a second primary transfer roller 40M, a third primary transfer roller 40C, and a fourth primary transfer roller 40K on opposite side of the intermediate transfer belt 20 and facing to the image carriers 24Y, 24M, 24C, and 24K of the image forming units (10Y, 10M, 10C, and 10K), respectively. The intermediate transfer unit 12 also includes carriage rollers (32, 34, and 36) that convey the intermediate transfer belt 20 in the direction of the arrow illustrated in FIG. 1.

As the carriage rollers (32, 34, and 36) rotate the intermediate transfer belt 20, the primary transfer rollers (40Y, 40M, 40C, and 40K) transfer the developer images of the respective colors formed on the image forming units (10Y, 10M, 10C, and 10K) onto the intermediate transfer belt 20 so that the developer images are superimposed.

The carriage roller 32, in conjunction with a carriage roller 38 provided on the conveying path 16, forms a secondary transfer unit to which a secondary transfer bias is applied. The carriage rollers (32 and 38) transfer at once the developer images superimposed on the intermediate transfer belt 20 onto the recording medium conveyed through the conveying path 16.

A belt cleaning unit 42 including a cleaning blade is provided on the downstream side of the secondary transfer unit. The belt cleaning unit 42 removes the developer remaining on the intermediate transfer belt 20 after the developer images have been transferred onto the recording medium.

The optical writing device 14 includes, for example, polygonal mirrors (50-1 and 50-2), fθ lenses (52-1, 52-2, . . . , 52-4), and turning mirrors (54-1, 54-2, . . . , 54-8).

The optical writing device 14 deflects light beams of different colors on the upper polygonal mirror (polygonal mirror 50-1) surface and the lower polygonal mirror (polygonal mirror 50-2) surface, and uses the light beams for scanning. Furthermore, the optical writing device 14 oppositely divides laser beams toward both sides of the polygonal mirrors (50-1 and 50-2), and thus scans the image forming units (10Y, 10M, 10C, and 10K) with the laser beams of four colors.

Here, a plurality of light-emitting elements 62, for example laser diodes mounted on LD control boards 60, emit the laser beams driven and modulated in accordance with the image data, and the polygonal mirrors (50-1 and 50-2) rotated by a polygon motor (not illustrated) deflect the laser beams. The deflected laser beams pass through the fθ lenses (52-1, 52-2, . . . , 52-4) and are reflected by the turning mirrors (54-1, 54-2, . . . , 54-8) to scan the image forming units (10Y, 10M, 100, and 10K), respectively.

In addition, but not illustrated, synchronization detection sensors may be provided in front of image writing start position in non-image writing area in the main-scanning direction. Upon receiving the laser beam deflected by the polygonal mirror, synchronization detection sensors output a synchronization detection signal in order to determine the timing of the start of writing in the main-scanning direction.

Figure 2:
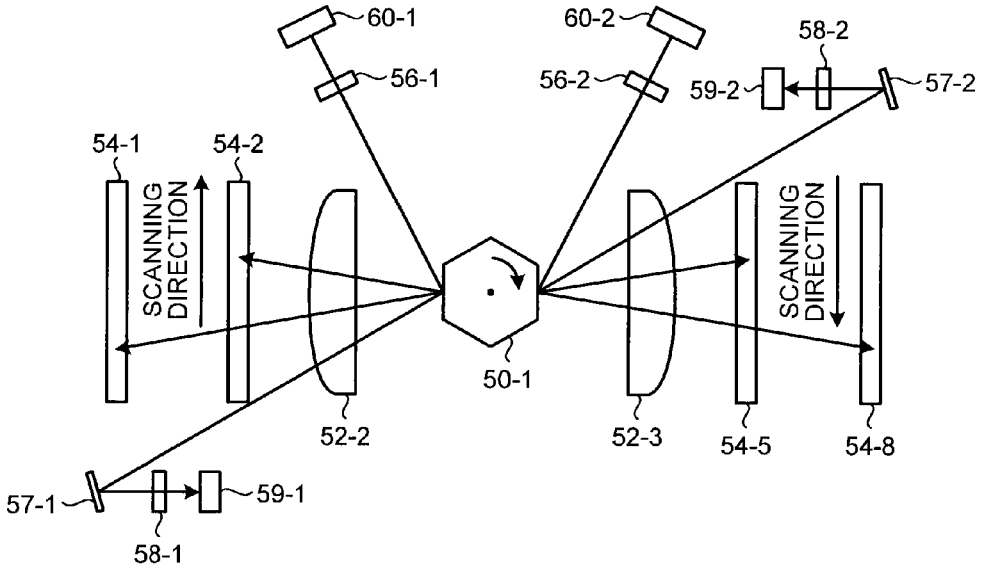
FIG. 2 is a top plane view of an optical writing device illustrated in FIG. 1.

FIG. 2 shows the optical writing device 14 illustrated in FIG. 1 as viewed from above. FIG. 2 does not illustrate invisible members, such as the polygonal mirror 50-2 that is positioned below the polygonal mirror 50-1 and thus is not visible. The laser beams (light beams) emitted by the LD control boards (60-1 and 60-2) pass through cylinder lenses (CYL) (56-1 and 56-2), respectively, and are incident on the polygonal mirror 50-1. The polygonal mirror 50-1 rotates to deflect the respective light beams. The deflected light beams pass through the fθ lenses (52-2 and 52-3), and are turned by the turning mirrors (54-2 and 54-5), respectively. Two of the light-emitting elements 62 for writing images of two kinds of colors are arranged in up-and-down direction on each of the LD control boards (60-1 and 60-2). The upper and the lower light-emitting elements 62 on each of the LD control boards (60-1 and 60-2) emit light beams onto the polygonal mirrors (50-1 and 50-2), respectively (see FIG. 1).

Both sides of writing start ends in the main-scanning direction are provided with synchronization mirrors (57-1 and 57-2), synchronization lenses (58-1 and 58-2), and synchronization sensors (59-1 and 59-2), respectively. The light beams of the respective colors after passing through the fθ lenses (52-2 and 52-3) are reflected by the synchronization mirrors (57-1 and 57-2), then are collected by the synchronization lenses (58-1 and 58-2), and are incident into the synchronization sensors (59-1 and 59-2). Each of the synchronization sensors (59-1 and 59-2) plays a role of a synchronization detection sensor for detecting a synchronization detection signal to determine the timing to start writing in the main-scanning direction.

Figure 3:
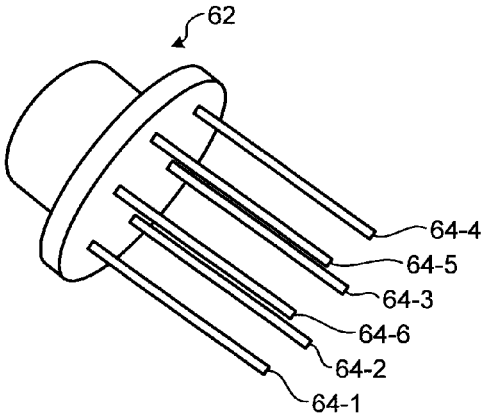
FIG. 3 is a perspective view of an exemplary light-emitting element.

FIG. 3 generally shows the light-emitting element 62. As illustrated in FIG. 3, the light-emitting element 62 is, for example, a four-channel (4-ch) laser diode having pin-like lead terminals (64-1, 64-2, . . . , 64-6), and emits four kinds of color beams. The terminals (64-1, 64-2, . . . , 64-6) consist of four laser diode terminals, a photodiode (PD) terminal, and a common terminal. The terminals (64-1, 64-2, . . . , 64-6) are arranged substantially parallel to each other. In the optical writing device 14, two of the light-emitting elements 62 are mounted on each of the two LD control boards (60-1 and 60-2), and thus, a total of four light-emitting elements 62 emit the light beams of 4-ch onto the image forming units (10Y, 10M, 100, and 10K). Note that the light-emitting elements 62 are not limited to the 4-ch laser diodes, but may be laser diodes of another type.

Figure 4:
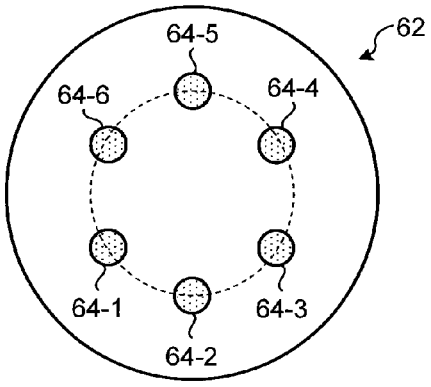
FIG. 4 is a bottom plane view of the exemplary light-emitting element illustrated in FIG. 3.

FIG. 4 shows the light-emitting element 62 illustrated in FIG. 3 as viewed from the terminals (64-1, 64-2, . . . , 64-6). On the light-emitting element 62, the terminals (64-1, 64-2, . . . , 64-6) are arranged along the perimeter of a circle indicated by a dotted line. The terminals (64-1, 64-2, . . . , 64-6) are arranged along the perimeter of the circle at regular intervals, but not limited to at regular intervals.

Figure 5:
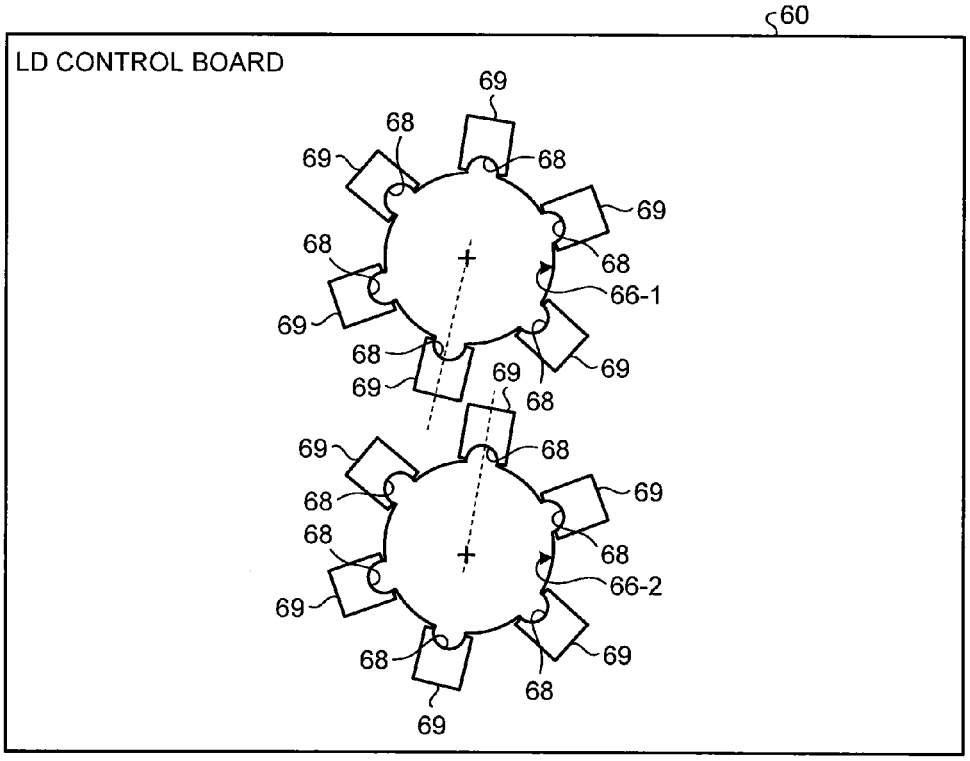
FIG. 5 is a top plane view of an exemplary LD control board.

FIG. 5 shows the LD control board 60 on which two of the light-emitting elements 62 are mounted. As illustrated in FIG. 5, the LD control board 60 includes two holes (66-1 and 66-2) into which the terminals (64-1, 64-2, . . . , 64-6) of the light-emitting elements 62 are inserted. The space between the holes (66-1 and 66-2) (i.e., distance between the center of the hole 66-1 and the center of the hole 66-2) corresponds to the space in the vertical direction between the polygonal mirrors (50-1 and 50-2), as illustrated in FIG. 1. Each of the holes (66-1 and 66-2) includes six (6) receiving portions 68 that each receive the terminals (64-1, 64-2, . . . , 64-6).

The receiving portions 68 are provided with respective solder terminals 69 for electrically connecting the terminals (64-1, 64-2, . . . , 64-6) thereto by soldering, for example. The solder terminals 69 are provided for electrically connecting the terminals (64-1, 64-2, . . . , 64-6) to a light-emitting element control IC or the like (not illustrated) that controls lighting of the light-emitting element 62, on the LD control board 60. The receiving portion 68 of the hole 66-1 and the adjacent receiving portion 68 of the adjacent hole portion 66-2 are provided such that a line drawn through the center of the hole 66-1 and the receiving portion 68 of the hole 66-1 is not align to a line drawn through the center of the hole 66-2 and the receiving portions 68 of the hole 66-2 in the state in which the space between the holes (66-1 and 66-2) is fixed. In other words, the light-emitting elements 62 can be mounted on the LD control board 60 with the center positions of the hole portions (66-1 and 66-2) fixed, while one light-emitting element 62 is rotated relative to the other light-emitting element 62.

Each of the holes (66-1 and 66-2) has a diameter greater than a diameter of perimeter of the terminals (64-1, 64-2, . . . , 64-6) illustrated in FIG. 4 so that the terminals (64-1, 64-2, . . . , 64-6) are capable of passing through the holes. After being inserted into each of the holes (66-1 and 66-2), the terminals (64-1, 64-2, . . . , 64-6) are bended and spread outwardly, and soldered.

In this manner, the receiving portion 68 of the hole 66-1 and the adjacent receiving portion 68 of the adjacent hole portion 66-2 are provided such that a line drawn through the center of the hole 66-1 and the receiving portion 68 of the hole 66-1 is not align to a line drawn through the center of the hole 66-2 and the receiving portions 68 of the hole 66-2. Therefore, the terminals (64-1, 64-6) can be easily soldered. In addition, the space between the holes (66-1 and 66-2) can be reduced, and the solder terminals 69 can be increased in size to improve the ease of soldering.

Figure 6:
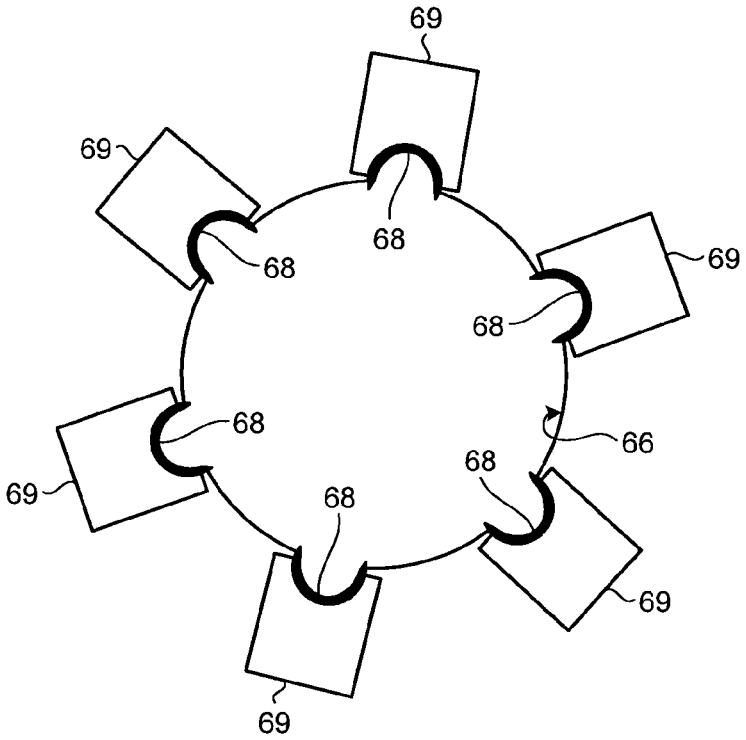
FIG. 6 is a schematic diagram illustrating receiving portions of the LD control board for receiving terminals.

FIG. 6 shows treatment of the receiving portions 68 of the LD control board 60 for receiving the terminals (64-1, 64-2, . . . , 64-6). The LD control board 60 remains insulated at parts of the receiving portions 68 which contact the terminals (64-1, 64-6) (i.e., surfaces facing the hole 66, that is, the thick line portions in FIG. 6). If conductive treatment is applied to the parts of the receiving portions 68 which contacts the terminals (64-1, 64-2, . . . , 64-6), the parts would be peeled from the ends thereof. It may lead to a short circuit between the terminals (64-1, 64-2, . . . , 64-6).

Figure 7:
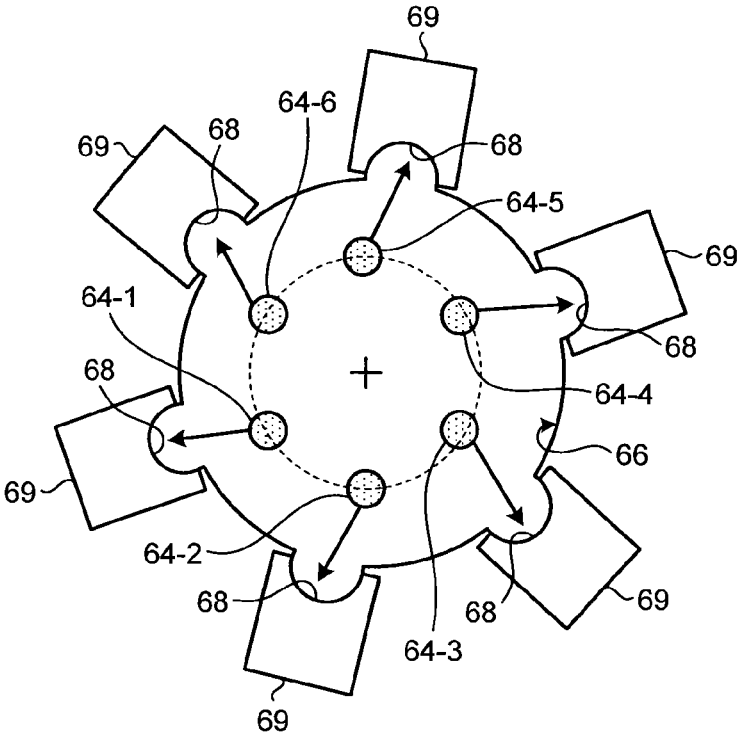
FIG. 7 is a schematic diagram illustrating a reception of the terminals in the respective receiving portions.

Next, a method for receiving the terminals (64-1, 64-2, . . . , 64-6) in the respective receiving portions 68 is described. FIG. 7 shows the method for receiving the terminals (64-1, 64-2, . . . , 64-6) in the respective receiving portions 68. The direction of mounting of the light-emitting element 62 may be determined according to optical characteristics, for example a beam pitch for the image forming units 10. Accordingly, the terminals (64-1, 64-2, . . . , 64-6) may be bended outwardly toward the receiving portions 68 that are displaced in the circumferential direction of the hole 66, as illustrated in FIG. 7. This allows soldering to be easily performed without changing the positions of the light beams.

Modification

Figure 8:
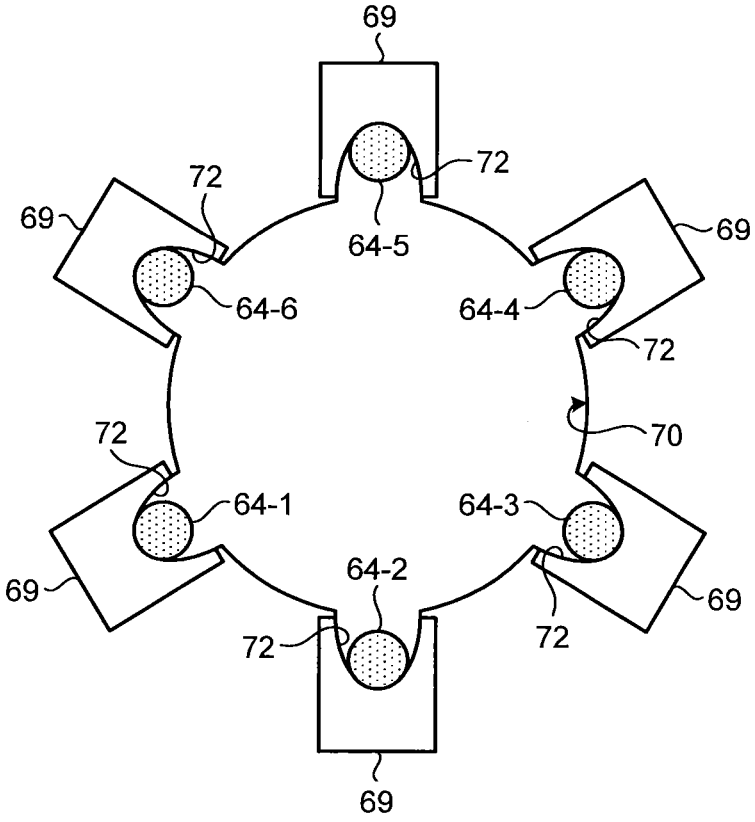
FIG. 8 is a schematic diagram illustrating an alternative embodiment of the LD control board.

FIG. 8 shows a modification example of the hole 66 of the LD control board 60. As illustrated in FIG. 8, the hole 70 includes receiving portions 72 that are recesses on the inner circumference of the hole 70. The each recesses has a size larger than a diameter of one of the terminals 64, and receives the terminals 64. The receiving portions 72 may be elongate holes, or simple circle having a diameter larger than that of the terminals 64. This facilitates solder to flow into spaces formed from the circumference of the hole 70 to the terminals 64, and thus can improve reliability and strength of the solder connection.

The present invention brings about an effect of allowing terminals of a plurality of light-emitting elements to be easily soldered when the light-emitting elements are closely mounted.

Although the invention has been described with respect to specific embodiments for a complete and clear disclosure, the appended claims are not to be thus limited but are to be constructed as embodying all modifications and alternative constructions that may occur to one skilled in the art that fairly fall within the basic teaching herein set forth.

What is claimed is:

1. A light-emitting substrate comprising:

a first light-emitting device including at least one first terminal;

a second light-emitting device including at least one second terminal; and a substrate having mounted thereon the first light-emitting device and the second light-emitting device, the substrate including a first hole having a first size to allow the at least one first terminal of the first light-emitting device to pass through and a second hole having a second size to allow the at least one second terminal of the second light-emitting device to pass through, the first hole and the second hole including at least one first receiving portion and at least one second receiving portion, respectively, the at least one first receiving portion and the at least one second receiving portion being concaved inward in a direction towards a first center of the first hole and a second center of the second hole, respectively, wherein the at least one first receiving portion of the first hole receives the at least one first terminal of the first light-emitting device, and the at least one second receiving portion of the second hole receives the at least one second terminal of the second light-emitting device, a first line drawn through the first center of the first hole and a third center of the at least one first receiving portion of the first hole does not align with a second line drawn through the second center of the second hole and a fourth center of the at least one second receiving portion of the second hole, a first width of a first opening of the at least one first receiving portion and a second width of a second opening of the at least one second receiving portion are larger than a diameter of each of the at least one first terminal and the at least one second terminal, and a distance between the first center of the first hole and the second center of the second hole corresponds to a vertical distance between a first polygon mirror and a second polygon mirror of an image forming apparatus.

2. The light-emitting substrate set forth in claim 1, wherein each of the at least one first receiving portion and the at least one second receiving portion has a surface that is untreated.

3. The light-emitting substrate set forth in claim 1, wherein a third size of the at least one first receiving portion and a fourth size of the at least one second receiving portion are larger than the diameter of the at least one first terminal and the at least one second terminal.

4. An optical writing device comprising:

the light-emitting substrate set forth in claim 1; and a photosensitive unit configured to receive light from the first light-emitting device and the second light-emitting device to allow electrostatic latent images to be written.

5. An image forming apparatus comprising the optical writing device set forth in claim 4.

6. The light-emitting substrate set forth in claim 1, wherein six receiving portions are arranged on a corresponding circumference of each of the first hole and the second hole.

7. The light-emitting substrate set forth in claim 1, wherein each of the at least one first terminal and the at least one second terminal is connected to a respective solder terminal.

8. A method for manufacturing a light-emitting substrate comprising:

preparing a first light-emitting device including at least one first terminal;

preparing a second light-emitting device including at least one second terminal;

preparing a substrate to mount thereon the first light-emitting device and the second light-emitting device, the substrate including a first hole having a first size to allow the at least one first terminal of the first light-emitting device to pass through and a second hole having a second size to allow the at least one second terminal of the second light-emitting device to pass through, the first hole and the second hole including at least one first receiving portion and at least one second receiving portion, respectively, the at least one first receiving portion and the at least one second receiving portion being concaved inwards in a direction towards a first center of the first hole and a second center of the second hole, respectively, and a first line drawn through the first center of the first hole and a third center of the at least one first receiving portion of the first hole does not align with a second line drawn through the second center of the second hole and a fourth center of the at least one second receiving portion of the second hole;

passing the at least one first terminal and the at least one second terminal through the first hole and the second hole, respectively;

spreading the at least one first terminal and the at least one second terminal outwardly so that the at least one first receiving portion of the first hole receives the at least one first terminal of the first light-emitting device, and the at least one second receiving portion of the second hole receives the at least one second terminal of the second light-emitting device; and soldering portions of the at least one first terminal and the at least one second terminal that are received by the at least one first receiving portion of the first hole and the at least one second receiving portion of the second hole, respectively, wherein a first width of a first opening of the at least one first receiving portion and a second width of a second opening of the at least one second receiving portion are larger than a diameter of each of the at least one first terminal and the at least one second terminal, and wherein a distance between the first center of the first hole and the second center of the second hole corresponds to a vertical distance between a first polygon mirror and a second polygon mirror of an image forming apparatus.

* * * * *